US005829493A

United States Patent [19]

Baranowski

[11] Patent Number: 5,829,493

[45] Date of Patent: Nov. 3, 1998

[54] APPARATUS FOR FILLING CONTAINERS WITH A LIQUID

[75] Inventor: John Baranowski, Bensalem, Pa.

[73] Assignee: Campbell Soup Company, Camden, N.J.

[21] Appl. No.: 709,540

[22] Filed: Sep. 6, 1996

[51] Int. Cl.[6] ..... B65B 1/04

[52] U.S. Cl. ..... 141/135; 141/132; 141/144; 141/171; 141/89; 134/200

[58] Field of Search ..... 141/129, 132, 141/134, 135, 144, 168, 170, 171, 250, 86, 88, 89–91, 99.85; 53/249, 250, 251, 253, 271, 273, 282, 283, 429; 134/147, 151–153, 166 R, 167 R, 199, 200

[56] References Cited

U.S. PATENT DOCUMENTS

| | | | |
|---|---|---|---|
| 935,506 | 9/1909 | Heybach | 53/429 |
| 2,058,976 | 10/1936 | Gray . | |
| 2,267,744 | 12/1941 | Nordquist . | |
| 2,634,893 | 4/1953 | Polk, Sr. et al. . | |
| 2,653,733 | 9/1953 | Rudd et al. . | |
| 2,785,707 | 3/1957 | Ryan, Jr. et al. . | |
| 2,951,514 | 9/1960 | Flack . | |
| 2,965,140 | 12/1960 | Wonneberger . | |
| 2,975,809 | 3/1961 | Ninneman et al. . | |
| 3,057,382 | 10/1962 | Baker . | |
| 3,087,652 | 4/1963 | Smith, Jr. . | |
| 3,107,703 | 10/1963 | Smith | 141/129 |
| 3,125,252 | 3/1964 | Heiss et al. . | |
| 3,152,622 | 10/1964 | Rothermel . | |
| 3,195,586 | 7/1965 | Vogt . | |
| 3,207,189 | 9/1965 | Vergobbi . | |
| 3,228,434 | 1/1966 | Johnson et al. . | |
| 3,369,577 | 2/1968 | Johnson et al. . | |
| 3,557,889 | 1/1971 | Rejsa . | |
| 3,579,950 | 5/1971 | Davis . | |
| 3,797,536 | 3/1974 | Pinto et al. | 141/134 |
| 3,843,023 | 10/1974 | Vroom . | |
| 4,010,594 | 3/1977 | Boyd . | |
| 4,024,896 | 5/1977 | Ishioka et al. . | |
| 4,103,720 | 8/1978 | Eisenberg . | |
| 4,349,053 | 9/1982 | Eisenberg | 141/135 |
| 4,417,607 | 11/1983 | Scholle et al. | 53/426 |
| 4,895,191 | 1/1990 | Drago | 141/132 |
| 4,899,790 | 2/1990 | Odenthal | 141/134 |
| 4,960,156 | 10/1990 | Tribert | 141/134 |
| 5,186,223 | 2/1993 | Rummage et al. . | |
| 5,297,596 | 3/1994 | Anson . | |
| 5,348,058 | 9/1994 | Ruhl . | |
| 5,458,166 | 10/1995 | Kronseder | 141/91 |

FOREIGN PATENT DOCUMENTS

| | | |
|---|---|---|
| 819 974 | 11/1951 | Germany . |
| 830 323 | 2/1952 | Germany . |
| 1148484 | 8/1958 | Germany . |
| 1174195 | 7/1964 | Germany . |
| 318101 | 1/1957 | Switzerland . |
| 371984 | 5/1932 | United Kingdom . |

*Primary Examiner*—J. Casimer Jacyna
*Assistant Examiner*—Steven O. Douglas
*Attorney, Agent, or Firm*—Banner & Witcoff, Ltd.

[57] ABSTRACT

An apparatus for filling containers with a liquid which includes a plurality of independent tanks positioned successively along a track that supports a series of containers. Each tank includes a weir for dispensing a liquid into the containers. The tanks are selectively fed with the liquid depending on the volume needed in the container. As a result, the volume of liquid dispensed into each container can be more accurately controlled. Funnels are provided for directing the liquid dispensed by the weirs into the open tops of the containers. The funnels are oriented vertically and close to the chain drive, even with the containers inclined, in order to lessen the loads placed on the chain drive for the funnels and thereby increase the mechanism's useful life. In addition, the funnels are passed through a cleaning assembly during a return segment to alleviate the need to shut down the machine to clean the funnels and thereby maximize the efficiency of the operation. The apparatus further includes a filling assembly, a closing assembly and a single drive mechanism for moving the containers through the filling assembly and the closing assembly.

13 Claims, 10 Drawing Sheets

APPARATUS FOR FILLING CONTAINERS WITH A LIQUID

FIELD OF THE INVENTION

The present invention pertains to an apparatus for filling containers with a liquid.

BACKGROUND OF THE INVENTION

The filling of containers with soup, juice and other food products has been accomplished by a number of different machines. In general, the containers (e.g., cans, jars, etc.) are moved seriatim along a prescribed path which feeds the containers into and through a filling machine. The containers are then typically transferred to a closing apparatus which applies ends, lids or caps to close the containers.

The filling operation is at times accomplished by individual spouts which direct a liquid from an overhead tank into individual containers (see, for example, U.S. Pat. No. 4,024,896). This construction, however, requires the coordination of a large number of components including even the tank which are raised, lowered and rotated. Other filling machines which involve fewer moving parts have relied upon an elongated stationary tank provided with a weir over which the liquid spills into the passing containers (see, for example, U.S. Pat. No. 4,103,720). In addition, funnels have also been used to direct the liquid from the weir to the containers. For products requiring further processing, the weir, the funnels, and the containers are typically placed in alignment at an incline to ensure the presence of an air bubble within the containers.

The past filling machines have been designed to dispense a specific volume of liquid into a prescribed container. However, there is a need to vary the volume based not only on different sizes of the containers, but also because of the addition of solids to the containers, such as with soups. While the dispensing volume can be varied by adjusting the speed of the containers along the prescribed path, accurate control of the operation across a wide range of volumes has not been possible. As a result, filling machines for soups and the like have generally provided spill tanks beneath the containers to collect the overflow liquid. An overflow of excess liquid can, though, result in solids (e.g., spices, meats, vegetables, etc.) being washed from the container with the liquids. As can be appreciated, this phenomenon reduces quality control of the materials within the containers. Further, due to the presence of solids in the spill tank, the excess liquid cannot be returned to the supply tank for reuse. Consequently, significant waste of the liquid is realized.

Spillage can also occur as the containers are moved from the filling machine to the closing machine. In particular, the containers typically engage and push each other through the filling machine as containers are added to the queue. However, since the closing machine requires separation of the containers, the drive mechanism for the closing machine operates to accelerate the lead container from the following container. This acceleration of the containers can cause some of the contents within the container to be spilled.

Further, as discussed above, funnels are used to direct the liquid from the weir to the container. Generally, the filling machines are continuously run on shifts of about eight hours, at which time the accumulated liquid residue needs to be cleaned from the funnels. Cleaning of the funnels requires the machine to be shut down. As a result, production time is lost not only during the actual cleaning operation, but also during a lag time to bring the machine back up to a steady state flow.

SUMMARY OF THE INVENTION

An apparatus in accordance with the present invention provides a more efficient filling operation with less waste. More specifically, the apparatus includes a plurality of tanks positioned successively along the track supporting the containers. Each tank includes a weir which overlies the track for filling the containers with a liquid. The tanks are selectively fed with the liquid depending on the volume needed in the containers. As a result, the volume of liquid dispensed into each container can be more accurately controlled.

The apparatus of the present invention preferably includes a filling assembly to dispense liquid into the containers and a closing assembly to attach closure elements to close the containers. A single drive mechanism is used to move the containers through the filling assembly and the closing assembly so that spillage during the transition is avoided.

Funnels are provided for directing the liquid dispensed by the weirs into the open tops of the containers. The funnels are oriented vertically and close to the chain drive, even when the containers are inclined. In this way the loads placed on the chain drive for the funnels are lessened, which in turn, increases the mechanism's useful life. In addition, the funnels are passed through a cleaning assembly during a return segment to obviate periodic machine shut downs to clean the funnels and thereby maximize the efficiency of the operation.

DETAILED DESCRIPTION OF THE PREFERRED EMBODIMENTS

Figure 1:
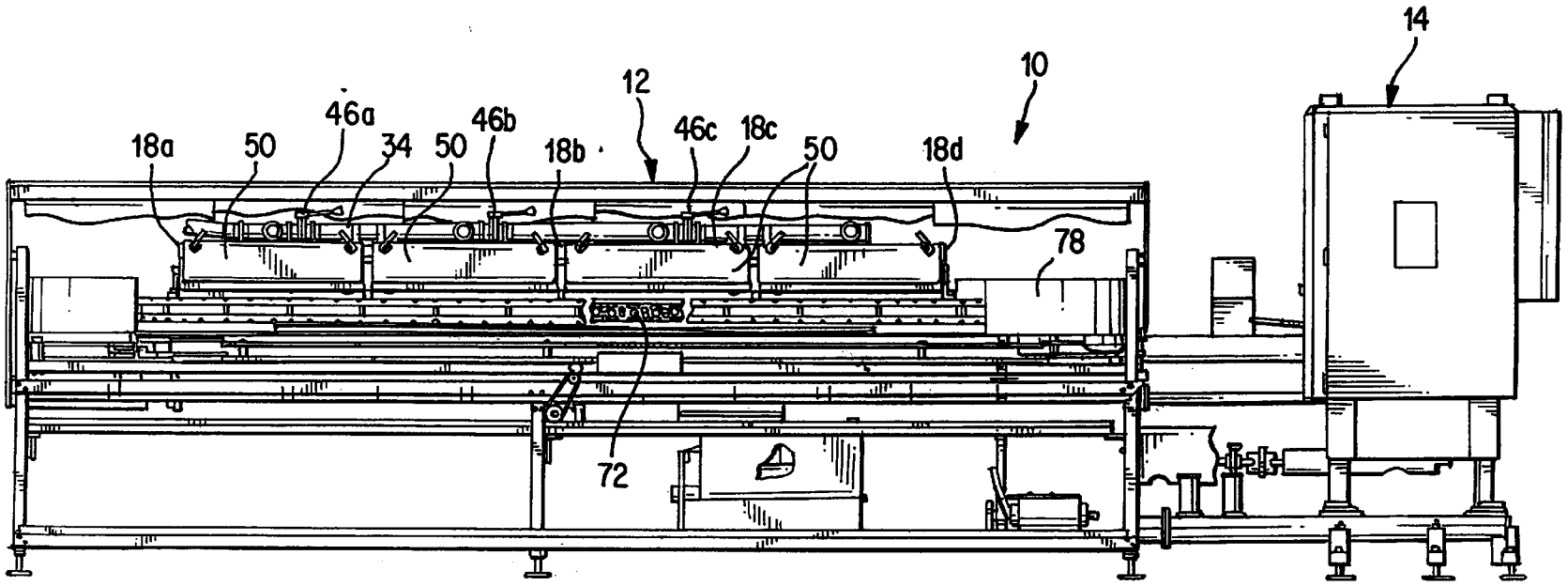
FIG. 1 is a front elevational view of an apparatus in accordance with the present invention.
Figure 2:
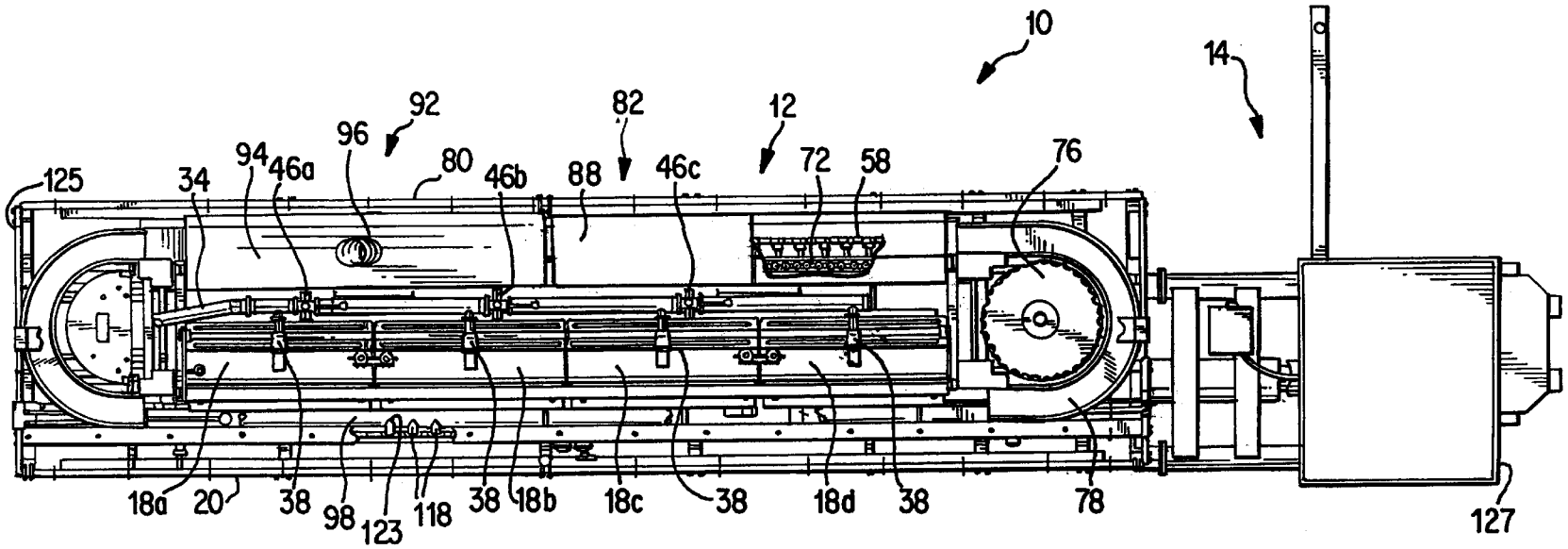
FIG. 2 is a top plan view of the apparatus.

An apparatus 10 in accordance with the present invention includes a filling assembly 12 and a closing assembly 14 (FIGS. 1 and 2). Containers 16 (e.g., cans, jars, etc.) having an open end 17 are fed into apparatus 10 (FIG. 6) to be filled with a liquid 15 by filling assembly 12, and closed with an end panel, cap, or lid by closing assembly 14.

Figure 3:
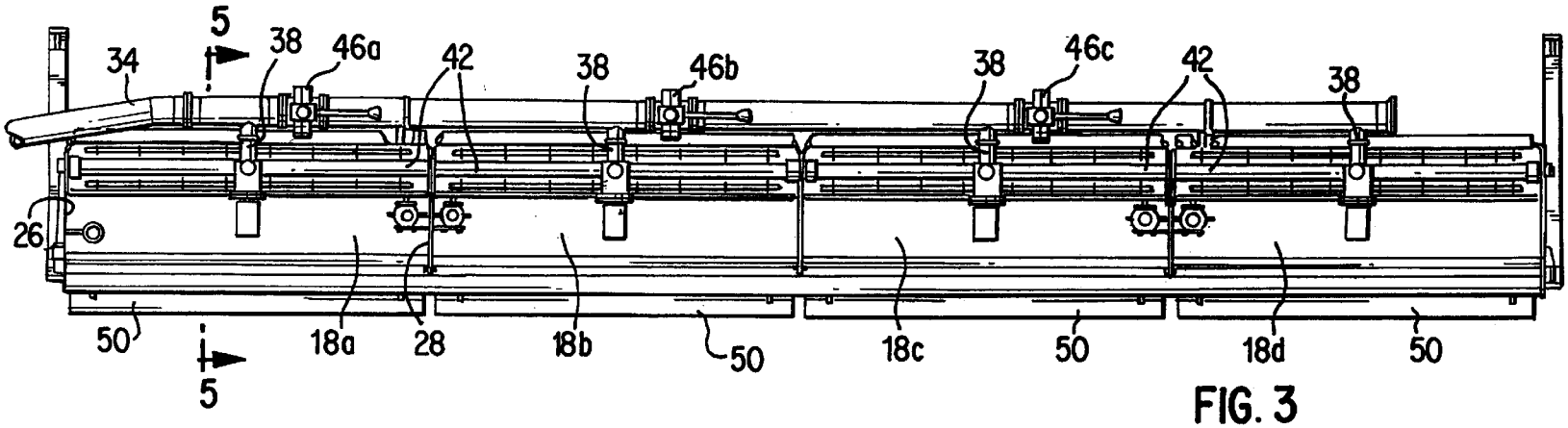
FIG. 3 is a top plan view of the tanks of the apparatus.
Figure 4:
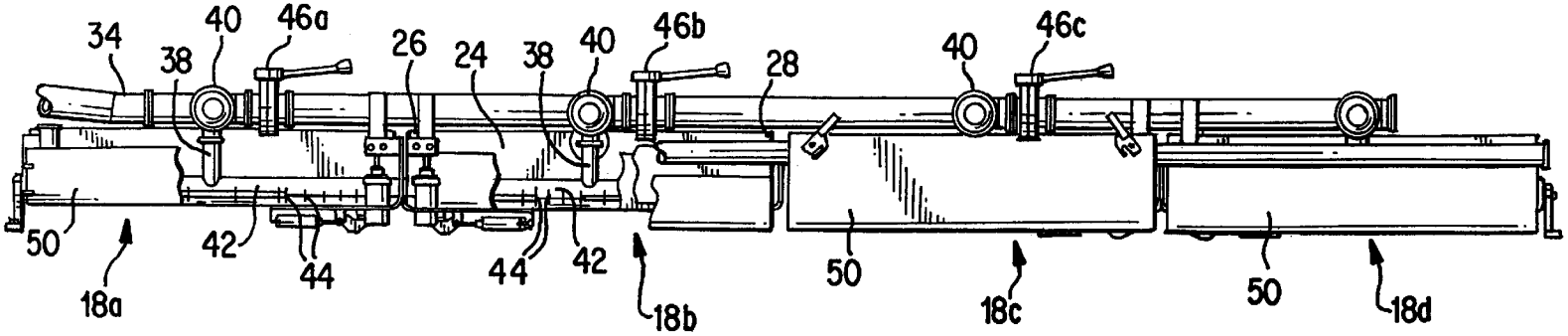
FIG. 4 is a front elevational view of the tanks.
Figure 5:
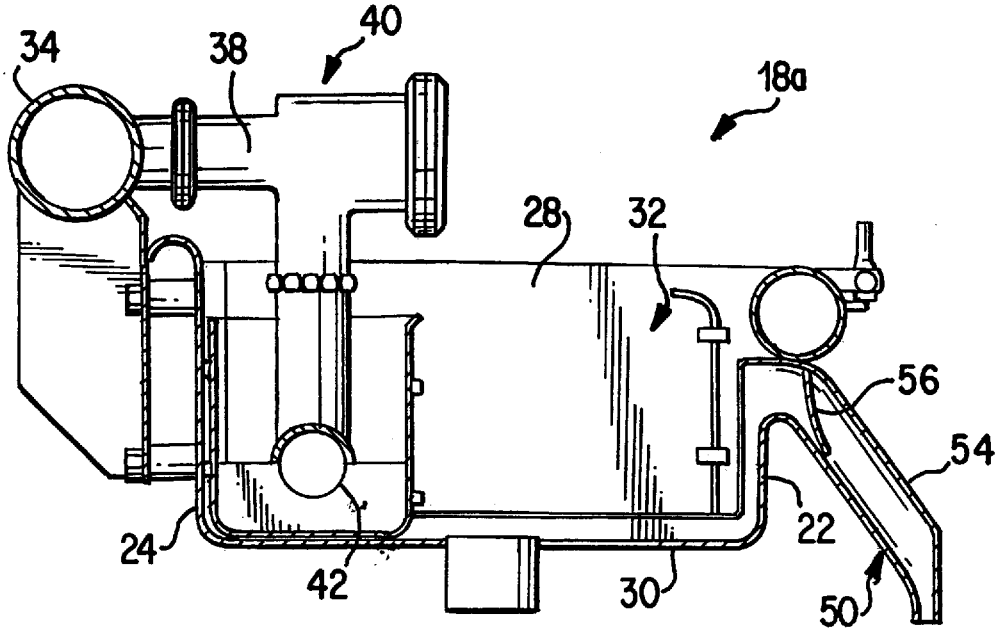
FIG. 5 is a cross-sectional view taken along line 5—5 in FIG. 3.

A plurality of tanks 18*a,* 18*b,* 18*c,* 18*d* are provided to dispense liquid 15 into the containers (FIGS. 1–5). Although four tanks are disclosed, a wide range of tanks could be used as desired. The tanks are arranged in a row successively along the front side 20 of apparatus 10. The tanks are each isolated so that the contained liquid does not flow from one tank to another. Each tank 18*a–d* has a generally parallelepiped shape with a front wall 22, a rear wall 24, a pair end walls 26, 28, and a bottom wall 30 to define an interior cavity 32 (FIGS. 3–5). While the tops of the tanks are open in the preferred construction, covers could be provided if desired.

A supply duct 34 transports the liquid to tanks 18*a–d* from a vat or the like (not shown), where the liquid, such as soup, juice, or other liquid food product, is stored and/or prepared (FIGS. 1–5). A feed pipe 38 for each tank 18*a–d* is fluidly coupled to supply duct 34 for directing the liquid into the corresponding tank. A valving system 40 is provided to control the rate of liquid flow through feed pipe 38 and into the corresponding tank (FIGS. 3–5). Feed pipe 38 directs the liquid to a longitudinal distribution pipe 42 which preferably extends across the entire length of each tank. Distribution pipe 42 is provided with a series of spaced apart apertures 44 through which liquid 15 is fed into tanks 18*a–d* (FIG. 4)

A series of valves 46*a*, 46*b*, 46*c* are provided along the length of supply duct 34 so that tanks 18*a–d* can be selectively fed with liquid 15 (FIGS. 1–5). Valves 46*a–c* are opened or closed to permit or preclude liquid 15 from flowing into tanks 18*b–d*. Specifically, when valve 46*a* is closed, liquid 15 is fed only to tank 18*a*. When valve 46*a* is open but valve 46*b* is closed, the liquid flows into tanks 18*a* and 18*b*. Similarly, when valves 46*a–b* are open and valve 46*c* is closed, the liquid flows into the first three tanks 18*a–c*. Finally, when all of the valves 46*a–c* are open, all of the tanks 18*a–d* are fed with the liquid from supply duct 34.

The front wall 22 of each tank 18*a–d* is provided with a weir 50 which extends across substantially the entire length of the tank (FIGS. 1 and 3–5). Each weir 50 has a lower sloped surface 52 over which liquid 15 spills and flows down to be dispensed into containers 16. Weirs 50 are preferably enclosed with a cover 54, but could be left open as desired. A squeegee element 56 is provided over each weir to prevent surface bubbles and the like from being swept into the containers (FIG. 5).

Figure 6:
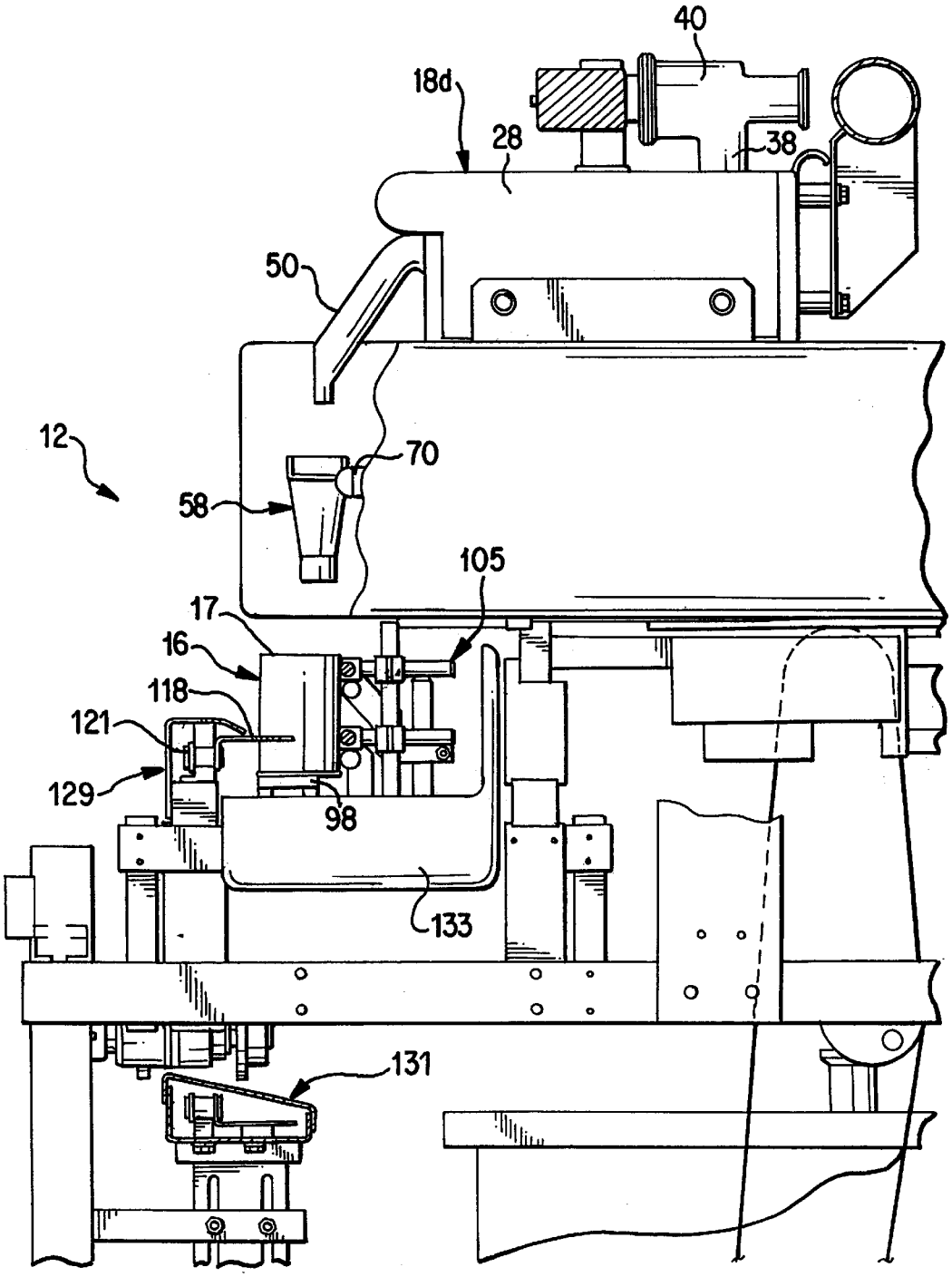
FIG. 6 is a partial end elevational view of the filling assembly of the apparatus.
Figure 7:
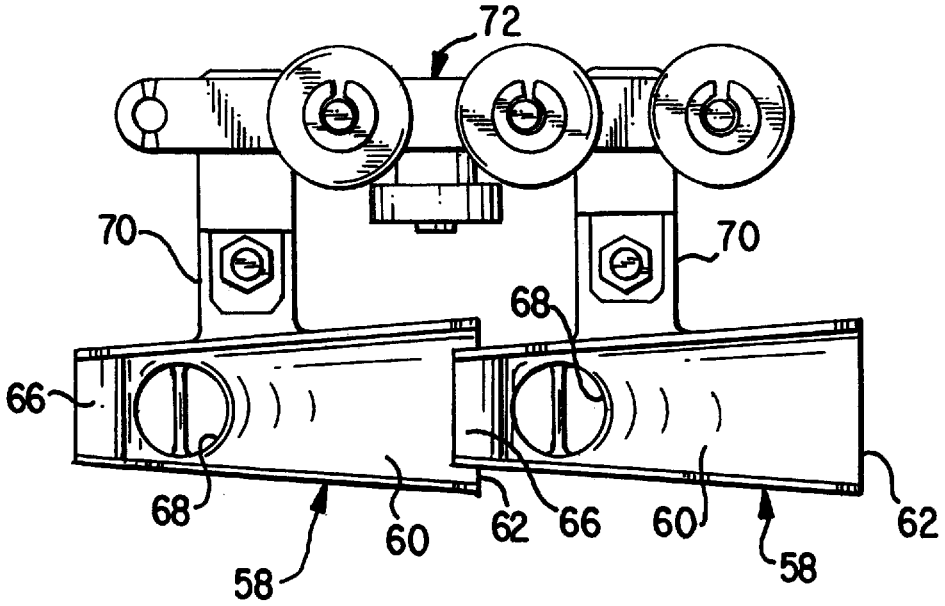
FIG. 7 is a partial top plan view of the funnels and accompanying chain drive of the apparatus.
Figure 8:
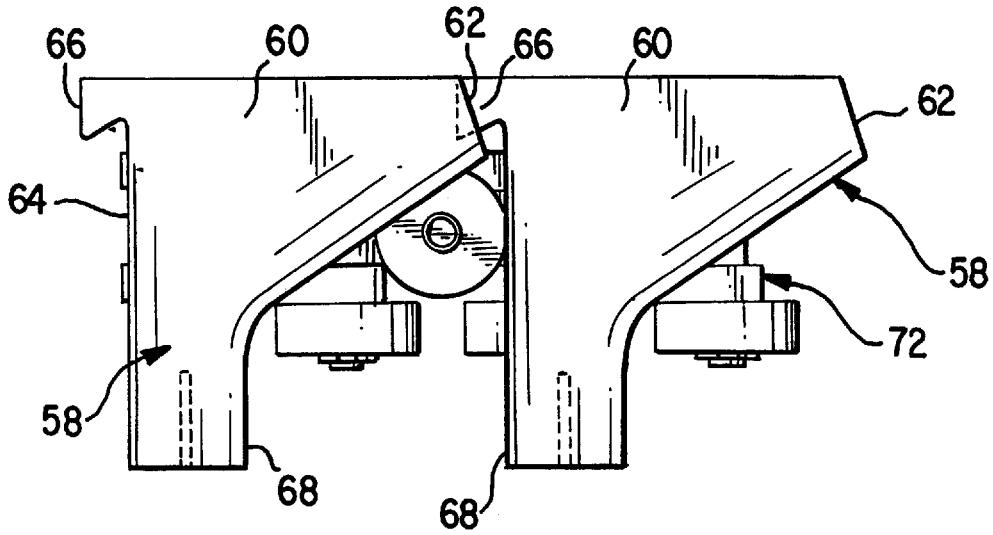
FIG. 8 is a partial front elevational view of the funnels and accompanying chain drive of the apparatus.

An endless series of funnels 58 are positioned to pass continuously beneath weirs 50 to ensure that the liquid dispensed from the tanks is received into containers 16 (FIGS. 6–8). Each funnel 58 is provided with an elongate, generally rectangular hopper portion 60 along its upper end. To avoid loss of the liquid, hopper portions 60 overlap with one another along their front and rear ends 62, 64. In particular, the front end 62 of each funnel 58 is cut away on its upper end to receive a rear overhang 66 from the adjacent funnel. The hopper portions of the funnels taper downwardly to form tubular outlets 68 through which the liquid is directed into containers 16.

Figure 11:
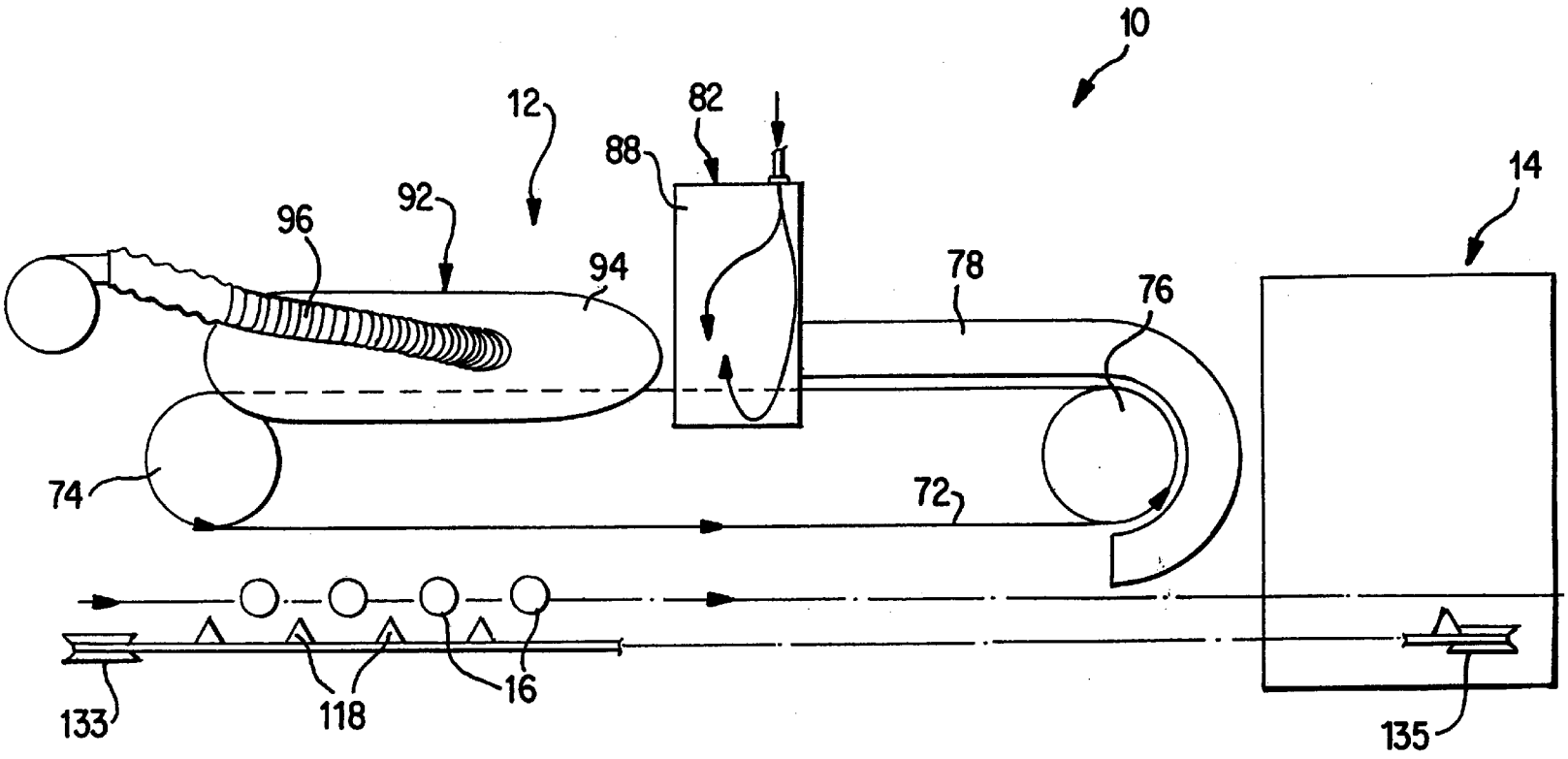
FIG. 11 is a schematic view illustrating the operation of the apparatus.
Figure 12:
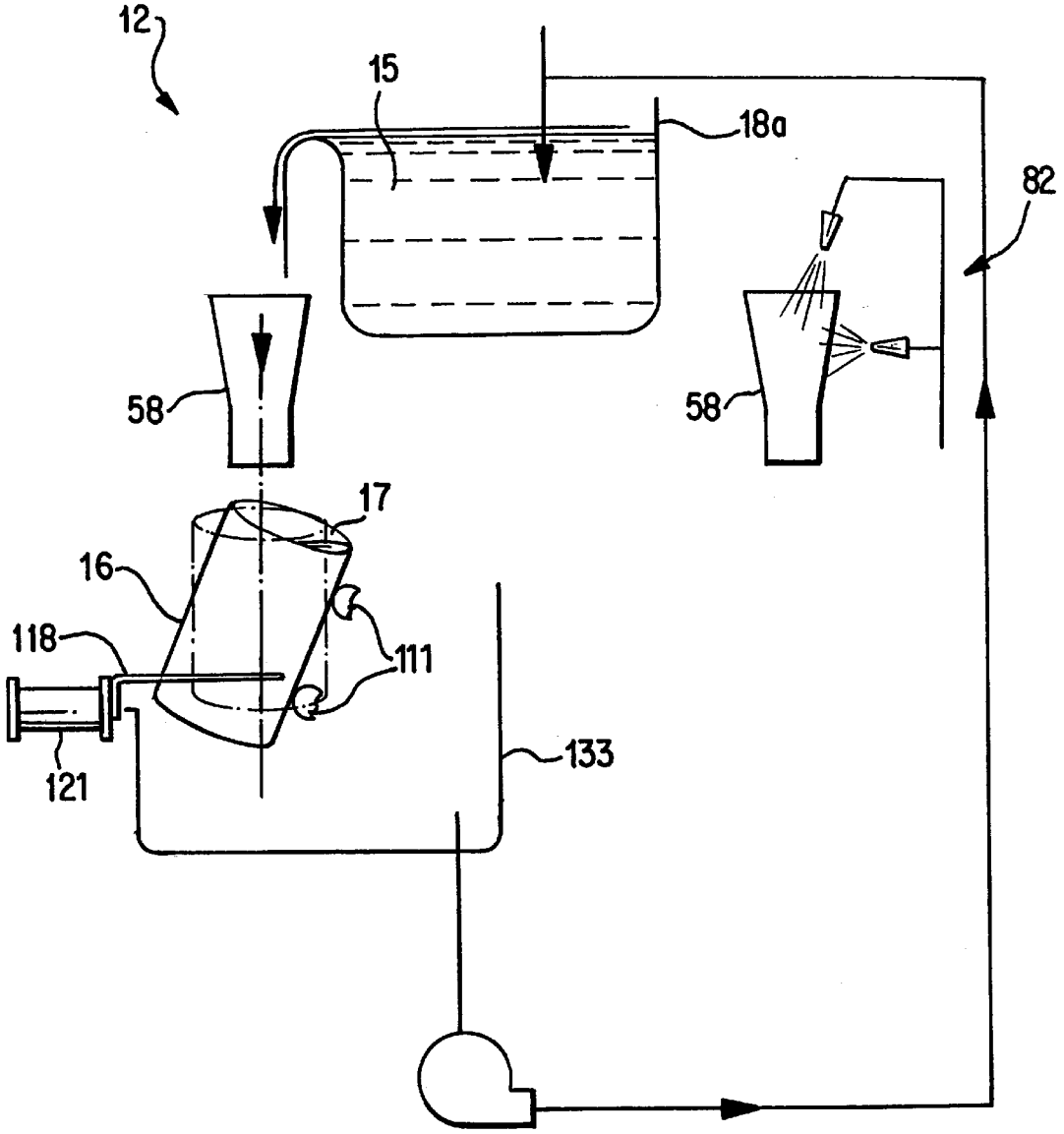
FIG. 12 is a schematic view illustrating the operation of the filling assembly of the apparatus.

Each funnel 58 further includes a mounting flange 70 which projects horizontally to connect the funnel to a drive chain 72 (FIGS. 6–8). The drive chain extends about drive sprocket 74 and idle sprocket 76 to direct funnels 58 about filling assembly 12 (FIGS. 2 and 11). As the funnels pass along the front side of filling assembly 12, liquid 15 pouring off one or more of the weirs is collected by hopper portions 60 and directed into containers 16 (FIGS. 6 and 12). One funnel corresponds and travels with one container across the front of the filling assembly. A trough 78 is positioned beneath the funnels as they travel about sprocket 76 and the first segment of the rear side 80 of filling assembly 12 to collect any liquid which drips from funnels 58 (FIGS. 2 and 11).

Figure 10:
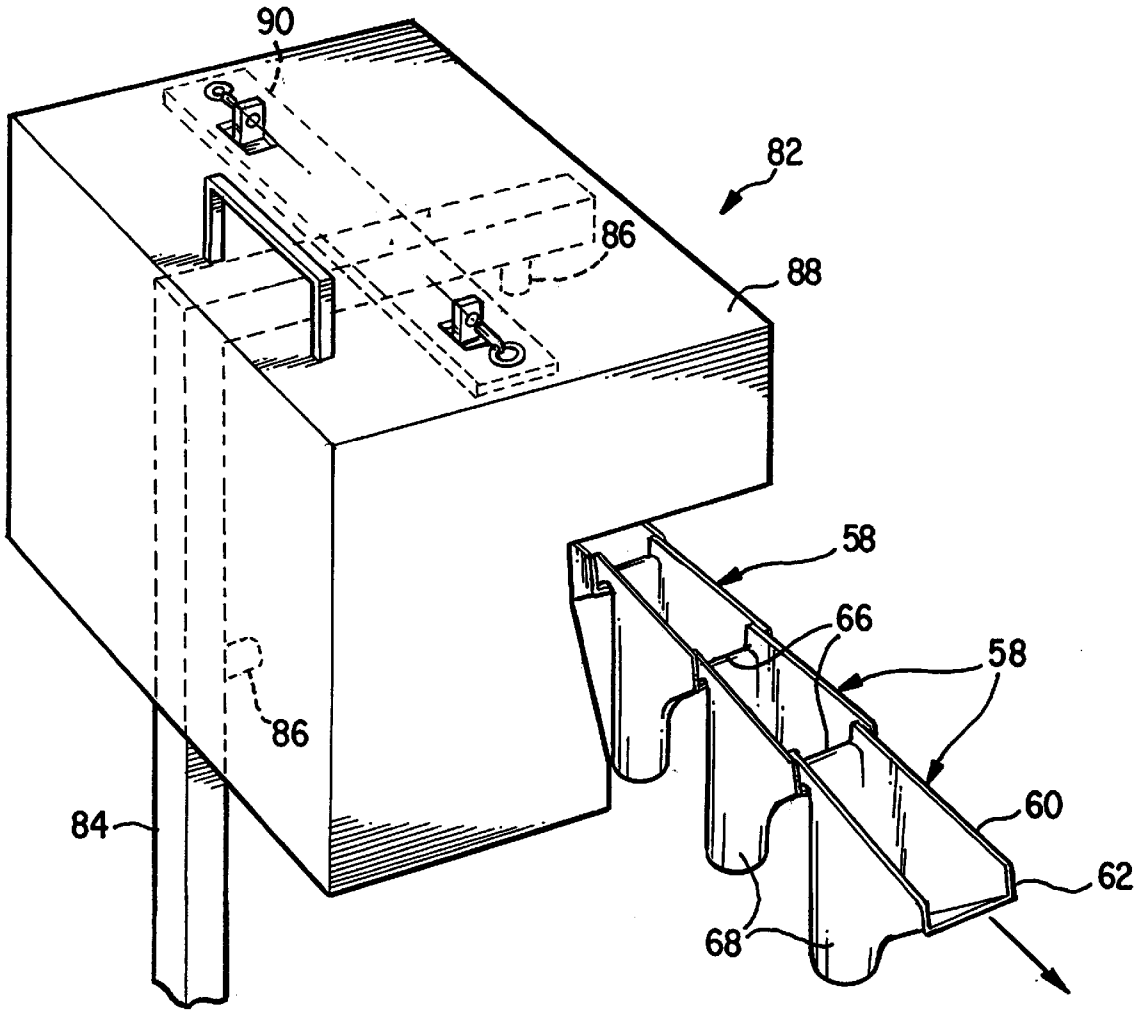
FIG. 10 is a partial perspective view of the funnels passing through the cleaning assembly of the apparatus.

Following trough 78, funnels 58 pass into a cleaning assembly 82 wherein the funnels are rinsed with a high pressure spray of water or other suitable liquid to clean the residue of the liquid from the funnels (FIGS. 2 and 10–12). In the preferred construction, a spray pipe 84 with a pair of nozzles 86 is positioned about funnels 58 (FIG. 10). A housing 88 is positioned to at least partially enclose the funnels being cleaned. In the preferred construction, housing 88 is secured to spray pipe 84 via a support bar 90. Nevertheless, other arrangements of nozzles and housings could be used.

In the preferred embodiment, cleaning assembly 82 is followed by a drying assembly 92, although the funnels could at times be left to air dry (FIGS. 2 and 12). Drying assembly 92 includes a hood 94 overlying funnels 58 for bathing the funnels in a stream of air. The air is pumped through air duct 96 to the top of hood 94. Although the air could be heated if necessary, air at room temperature is generally sufficient.

Figure 9:
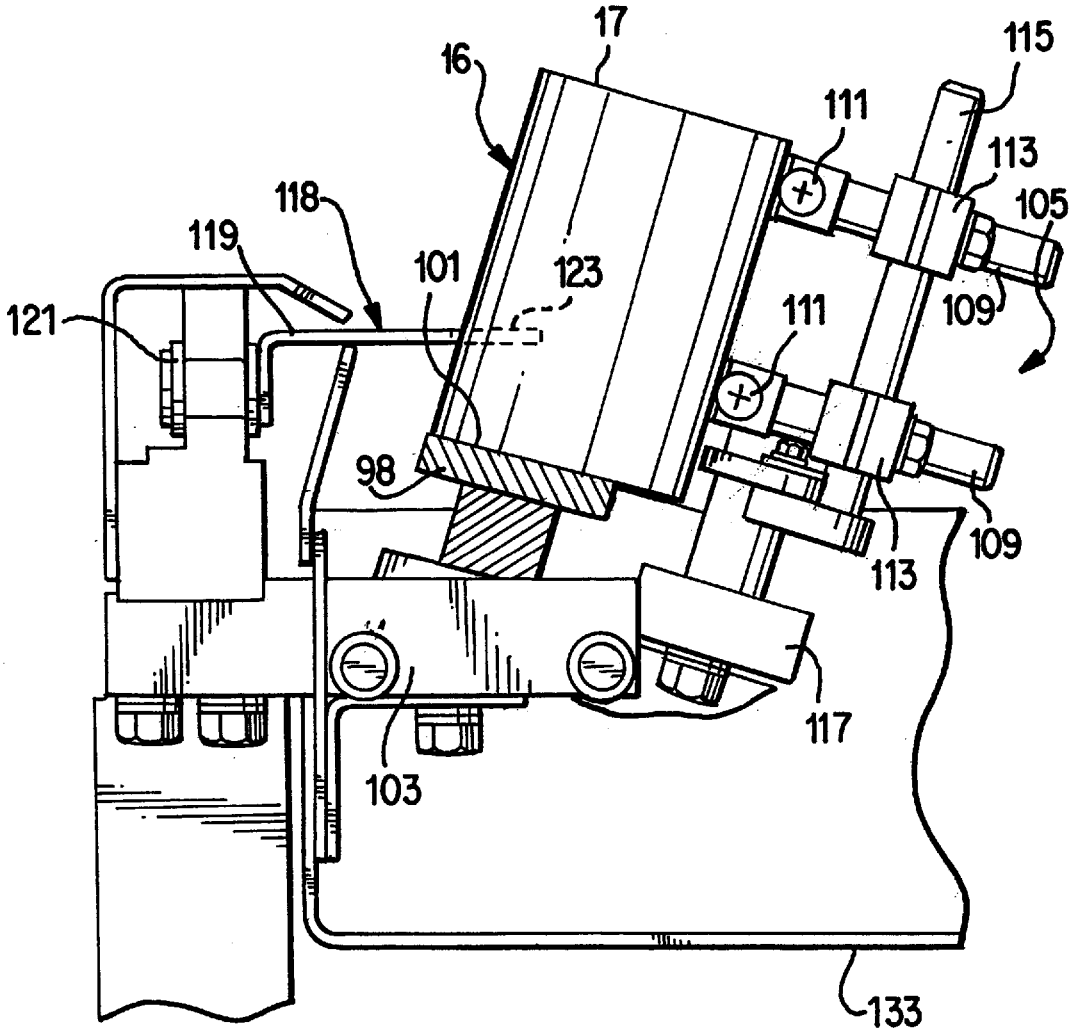
FIG. 9 is a partial end elevational view of the container drive mechanism of the apparatus.

Containers 16 are moved with funnels 58 along a track 98 so as to pass beneath weirs 50 (FIGS. 6 and 12). Track 98 is composed of elongate segments which form a continuous path through the filling and closing assemblies 12, 14. Containers 16 are initially fed into apparatus 10 along a horizontal support surface 101. While the containers can be maintained vertically throughout the entire filling operation, the track can be adjusted to set containers 16 at a slight incline (e.g., 5°) as they pass beneath weirs 50 (FIGS. 9 and 12). Track 98 is preferably secured to a stationary bed 103 provided with an arcuate guideway (not shown) for permitting the desired inclination of containers 16 (FIG. 9). The containers are inclined to ensure that a bubble or air space is provided in the container after it is sealed. The air bubble is commonly needed for proper processing of the product after closing. Once containers 16 pass weirs 50, they are again oriented vertically for passage through closing assembly 14. Movement of the containers between the vertical and inclined positions is accomplished by transition segments (not shown) which provide a generally smooth adjustment.

Containers 16 are guided along track 98 by a framework 105 (FIG. 9). Framework 105 includes bars 109 which support elongate horizontal guide rods 111 that extend along the length of the track and engage the sides of the containers. Support bars 109 are adjustable via connectors 113 both vertically and horizontally along posts 115 in order to properly position guide rods 111 to accommodate different sizes of containers. Posts 115 are mounted on bases 117 which, in turn, are connected to track 98. Consequently, framework 105 rotates with track 98.

Despite the rotation of track 98, funnel 15 remains in a vertical orientation. In this way, the funnels can be held closer to chain 121 as compared to the past practice of inclining the funnels with the containers. As a result, smaller moment loads are placed on the chain, which in turn, increases the chain's useful life.

Fingers 118 are provided in an opposed relationship with framework 105 to engage and move containers 16 along track 98 (FIGS. 2, 6, 9 and 11). More specifically, fingers 118 each include an L-shaped base 119 for attachment to a chain 121, and a narrowing projection 123 to engage container 16. As seen in FIG. 2, a gap is defined between each pair of adjacent projections 123 to receive a container. Chain 121 and fingers 118 forms an endless drive mechanism for pushing the containers through filling assembly 12 and closing assembly 14. In the preferred construction, chain 121 is looped about a pair of sprockets 133, 135 at opposite ends 125, 127 of apparatus 10 (FIG. 11). One of the sprockets is driven by a motor (not shown) to move the chain and attached fingers. The upper section 129 of the loop defines a chain drive for moving the containers along track 98 (FIG. 6). The lower section 131 of the loop defines a return path for the chain.

In operation, containers 16 are fed seriatim onto track 98 wherein they are individually engaged by fingers 118 (FIG. 11). Fingers 118 are moved forward by chain drive 121 to advance containers 16 along a preferably straight path defined by the track. As discussed above, the segments of the track underlying weirs 50 are rotated to incline containers 16 (FIGS. 9 and 11). In filling assembly 12, funnels 58 are synchronized to travel with containers 16 between weirs 50 and containers 16.

Apparatus 10 is used to fill containers 16 with a number of different products including soups, juices, fruits, etc. Depending on the ultimate product, containers 16 may at the time they enter apparatus 10 be empty or filled with a variety of solids, such as spices, vegetables, meats, or other ingredients. Accordingly, different volumes of liquid are needed to fill the containers, even when the containers of different runs are of the same size. The number of tanks 18*a–d* filled during any particular run will depend on the volume of liquid which needs to be dispensed into the containers. For instance, if a large volume of liquid is needed (i.e., if the containers are empty or large) then all the valves 46*a–c* are opened to fill all four tanks 18*a–d* with liquid 15 (FIGS. 1–6). In this way, liquid spills over the weirs 50 of each tank 18*a–d,* through funnels 58, and into containers 16 as the containers travel along track 98. However, if a smaller amount of liquid is required, then one or more of valves 46*a–c* can be closed to run less than all of the tanks. Under these circumstances, containers 16 will only receive liquid from the tanks in operation. While the containers will still travel beneath the weirs of the unused tanks, they will receive no extra liquid. The control of the volume of liquid dispensed can additionally be fine tuned by adjusting the speed of the chains 72, 121 for the funnels 58 and containers 16.

While unprecedented control in the filling of containers with a wide variety of volumes can be achieved with apparatus 10, a reclaim tank 133 is still positioned beneath containers 16 in filling assembly 12 to recapture any of the liquid which may spill (FIGS. 6 and 12). The spillage, however, is small and thus is not contaminated with solids washed out of the containers. As a result, the recaptured liquids can be recycled to the main vat or the like for reuse in tanks 18*a–d* (FIG. 12). Reclaim tank 133 also collects any of the liquid which may not be received by containers 16 in a start up or transition phase.

After filling, funnels 58 are rotated about sprocket 76 and fed through cleaning assembly 82 and drying assembly 92 (FIGS. 2, 11 and 12). A trough 78 preferably underlies the funnels as they travel from weirs 50 to cleaning assembly 82 to catch liquid which may drip from the funnels (FIGS. 2 and 11). The liquid caught by trough 78 is preferably recycled to tanks 18*a–d* to minimize loss of material.

After filling, the containers are moved to closing assembly 14 (FIGS. 1, 2 and 11). Closing assembly 14 is a conventional device for attaching a closure element over the open end 17 of the container. As examples, closing assembly 14 may seam an end panel to a can or attach a lid to a jar in a manner well known to those in the industry. Accordingly, the details of the closing assembly are not herein discussed. In any event, the chain drive 121 functions to continuously move containers 16 at a steady rate along track 98 into and trough closing assembly 14. In this way, the contents of the containers are not spilled during a transitional phase of moving from one assembly to another.

The above discussion concerns the preferred embodiments of the present invention. Various other embodiments as well as many changes and alterations may be made without departing from the spirit and broader aspects of the invention as defined in the claims.

I claim:

1. An apparatus for filling containers with a liquid comprising:

a track for supporting a series of containers;

a drive mechanism for moving the containers along said track;

a plurality of tanks positioned successively along said track, each said tank including a weir which generally overlies said track;

a feeding assembly which selectively fills said tanks with a liquid so that one or more tanks dispense the liquid over said weirs and into the containers moving along said track, said feeding assembly including funnels for directing the liquid into the containers and a second drive mechanism for moving one funnel with each container, said funnels being moved along an endless course, said endless course including a filling segment where said funnels overlie and move with the containers to fill the containers with the liquid, and a return segment where said funnels are separated from the containers;

a cleaning assembly along said return segment to clean residue from said funnels as said funnels move along said endless course; and a drying assembly for drying said funnels which have been cleaned prior to said funnels returning to said filling assembly.

2. An apparatus in accordance with claim 1 in which said track sets the containers being filled with a liquid at an inclined orientation.

3. An apparatus in accordance with claim 2 which further includes funnels for directing the liquid into the containers and a second drive mechanism for moving one funnel with each container.

4. An apparatus in accordance with claim 3 in which said funnels are oriented vertically such that the longitudinal axes of the containers are inclined relative to the longitudinal axes of the funnels.

5. An apparatus for filling containers with a liquid comprising:

a track along which containers are moved;

a drive mechanism for moving said containers along said track;

at least one tank positioned along said track, said tank including a weir for dispensing a liquid;

a plurality of funnels positioned between said weir and said track, to direct the liquid into the containers;

a drive mechanism for moving said funnels along an endless course, said endless course including a filling segment wherein said funnels overlie and move with the containers to thereby fill the containers with the liquid, and a return segment wherein said funnels are removed from the containers; and a cleaning assembly along said return segment to clean residue from said funnels as said funnels move along said endless course.

6. An apparatus in accordance with claim 5 in which said cleaning assembly includes at least one spray nozzle for spraying said funnels to clean the residue from the funnels.

7. An apparatus in accordance with claim 5 which further includes a drying assembly for drying said funnels which have been cleaned prior to said funnels returning to said filling segment.

8. An apparatus in accordance with claim 5 which further includes a trough under the return course of the funnels prior to said cleaning assembly to collect liquid which drips from said funnels.

9. An apparatus for filling containers with a liquid comprising:

a track along which containers are moved;

a drive mechanism for moving said containers along said track;

at least one tank positioned along said track, said tank including a weir for dispensing a liquid;

a plurality of funnels positioned between said weir and said track, to direct the liquid into the containers;

a drive mechanism for moving said funnels along an endless course, said endless course including a filling segment wherein said funnels overlie and move with the containers to thereby fill the containers with the liquid, and a return segment wherein said funnels are removed from the containers; and a cleaning assembly along said return segment including at least one spray nozzle for spraying said funnels to clean residue from said funnels as said funnels move along said endless course and a housing about said funnels being sprayed.

10. An apparatus for filling containers with a liquid comprising:

a track along which a series of containers having an open end are moved;

a filling assembly including at least one tank having an elongate weir over said track for dispensing a liquid in an unsupported sheet;

a plurality of overlapping funnels positioned between said weir and said track such that each container underlies one of said funnels which directs the liquid being dispensed by said weir into the open end of the containers moving along said track;

a closing assembly adjacent said filling assembly for attaching a closure element over the open end of each container moving along said track; and a single drive mechanism for continuously moving said containers along said track and through said filling assembly and said closing assembly.

11. An apparatus in accordance with claim 10 in which said drive mechanism includes an endless chain drive provided with a series of pusher elements for moving the containers seriatim along said track in a spaced relationship to each other.

12. An apparatus for filling containers with a liquid comprising:

a track along which a series of containers are moved, said track having a filling section which supports the containers at an inclination;

a first drive assembly for moving said containers along said track;

at least one tank positioned along said track, said tank including an elongate weir for dispensing a liquid in an unsupported sheet along said filling section;

a plurality of overlapping funnels positioned between said weir and said track such that each container underlies one of said funnels so as to direct the liquid being dispensed by said weir into the inclined containers, each said funnel having a longitudinal axis which is oriented substantially vertically; and a second drive assembly for moving said funnels in concert with the containers through said filling section.

13. An apparatus in accordance with claim 12 in which said first and second drive assemblies are chain drives.

* * * * *